US011085194B2

(12) United States Patent
Boyd et al.

(10) Patent No.: US 11,085,194 B2
(45) Date of Patent: Aug. 10, 2021

(54) MOMENT CONNECTION COMPONENT LIFTING TOOL ASSEMBLY

(71) Applicant: ConXtech, Inc., Pleasanton, CA (US)

(72) Inventors: John S. Boyd, Tiburon, CA (US); Kevin Marek, Hayward, CA (US); Eric Bellman, Hayward, CA (US); Maxwell C. Simmons, Hayward, CA (US); Robert J. Simmons, Hayward, CA (US); Brian Hood, San Francisco, CA (US)

(73) Assignee: ConXtech, Inc., Pleasanton, CA (US)

( * ) Notice: Subject to any disclaimer, the term of this patent is extended or adjusted under 35 U.S.C. 154(b) by 0 days.

(21) Appl. No.: 16/271,747

(22) Filed: Feb. 8, 2019

(65) Prior Publication Data

US 2019/0249451 A1 Aug. 15, 2019

Related U.S. Application Data

(60) Provisional application No. 62/628,837, filed on Feb. 9, 2018, provisional application No. 62/628,807, filed on Feb. 9, 2018.

(51) Int. Cl.

| | |
|---|---|
| ***E04G 21/16*** | (2006.01) |
| ***E04B 1/19*** | (2006.01) |
| ***B66C 1/64*** | (2006.01) |

(52) U.S. Cl.

CPC ..... *E04G 21/162* (2013.01); *B66C 1/64* (2013.01); *E04B 1/1903* (2013.01); *E04B 2103/06* (2013.01)

(58) Field of Classification Search

CPC .... B66C 1/28; B66C 1/30; B66C 1/62; B66C 1/64; E04G 21/162; E04B 1/1903; E04B 2103/06

USPC ..... 294/67.31, 82.13, 85

See application file for complete search history.

(56) References Cited

U.S. PATENT DOCUMENTS

| | | | | |
|---|---|---|---|---|
| 835,059 | A | 11/1906 | Curley | |
| 925,677 | A | 6/1909 | Belcher | |
| 1,110,185 | A | 9/1914 | Brown et al. | |
| 1,216,291 | A * | 2/1917 | Diescher | B66C 1/32 294/67.31 |

(Continued)

FOREIGN PATENT DOCUMENTS

| | | | |
|---|---|---|---|
| DE | 2758992 | A1 | 7/1979 |
| DE | 102009050139 | A1 | 4/2011 |

(Continued)

OTHER PUBLICATIONS

U.S. Receiving Office of WIPO, International Search Report regarding PCT Patent Application No. PCT/US19/17373, dated Apr. 30, 2019, 6 pages.

(Continued)

*Primary Examiner* — Dean J Kramer

(74) *Attorney, Agent, or Firm* — Kolisch Hartwell, P.C.

(57) ABSTRACT

A lifting tool assembly is disclosed, including a crossbar having a long axis spanning between first and second end portions. A first hook member is pivotably suspended from the first end portion and a second hook member is pivotably suspended from the second end portion. The end portions are symmetrically angled relative to the long axis and each hook member includes first and second finger structures.

17 Claims, 3 Drawing Sheets

(56) References Cited

U.S. PATENT DOCUMENTS 1,367,044 A 2/1921 Hausler
1,400,066 A 12/1921 Huck
1,471,094 A 10/1923 Bloss
1,729,743 A 10/1929 Jorgensen et al.
2,008,087 A 7/1935 Stromberg
2,260,708 A 10/1941 French
2,421,257 A 5/1947 Genter
2,441,026 A * 5/1948 Long ..... B66C 1/28 294/110.1
2,569,653 A 10/1951 Boedecker
2,673,700 A 3/1954 Eberhardt
2,942,557 A 6/1960 Hirsch et al.
3,071,205 A 1/1963 Beck, Jr.
3,148,477 A 9/1964 Bjørn et al.
3,154,203 A 10/1964 Barry
3,220,760 A * 11/1965 Buchik ..... B66C 1/64 294/81.61
3,270,997 A 9/1966 Gethmann
3,396,499 A 8/1968 Biffani
3,401,739 A 9/1968 Opletal
3,410,044 A 11/1968 Moog
3,499,676 A 3/1970 Haeussler
3,533,592 A 10/1970 Jennings
3,562,988 A 2/1971 Gregoire
3,584,830 A 6/1971 Koehn
3,664,011 A 5/1972 Labastrou
3,685,866 A 8/1972 Patenaude
3,706,169 A 12/1972 Rensch
3,784,151 A 1/1974 Steele
3,829,999 A 8/1974 Bernstein
3,977,801 A 8/1976 Murphy
4,014,151 A 3/1977 Erhart
4,019,298 A 4/1977 Johnson, IV
4,059,931 A 11/1977 Mongan
4,105,240 A 8/1978 Steenson et al.
4,306,397 A 12/1981 Ramseyer
4,360,230 A 11/1982 Wood et al.
4,371,203 A 2/1983 Munro
4,398,762 A 8/1983 Haeussler et al.
4,438,607 A 3/1984 Nelson
4,522,001 A 6/1985 Meyer
4,563,031 A 1/1986 Kishimoto et al.
4,577,449 A 3/1986 Celli
4,671,724 A 6/1987 Bolton
4,684,285 A 8/1987 Cable
4,701,131 A 10/1987 Hildebrandt et al.
4,705,312 A 11/1987 Vooge et al.
4,736,554 A 4/1988 Tyler
4,742,665 A 5/1988 Baierl
4,754,712 A 7/1988 Olson et al.
4,769,960 A 9/1988 Zipf et al.
4,821,844 A 4/1989 Huffman et al.
4,830,144 A 5/1989 Werner
4,852,501 A 8/1989 Olson et al.
4,905,436 A 3/1990 Matsuo et al.
5,061,111 A 10/1991 Hosokawa
5,240,089 A 8/1993 Spera
5,244,300 A 9/1993 Perreira et al.
5,289,665 A 3/1994 Higgins
5,342,138 A 8/1994 Saito et al.
5,480,201 A 1/1996 Mercer
5,590,974 A 1/1997 Yang
5,605,410 A 2/1997 Pantev
5,615,529 A 4/1997 Johnson et al.
5,617,931 A 4/1997 Zygmun et al.
5,678,375 A 10/1997 Juola
5,704,675 A * 1/1998 Reiley ..... B66C 1/54 294/62
5,826,927 A 10/1998 Long
6,062,620 A * 5/2000 Walker ..... B66C 1/28 294/67.31
6,082,070 A 7/2000 Jen
6,092,347 A 7/2000 Hou
6,106,186 A 8/2000 Taipale et al.
6,219,989 B1 4/2001 Tumura
6,378,265 B1 4/2002 Konstandt
6,390,719 B1 5/2002 Chan
6,554,102 B2 4/2003 Schwörer
6,651,393 B2 11/2003 Don et al.
6,802,169 B2 10/2004 Simmons
6,837,016 B2 1/2005 Simmons et al.
6,913,422 B2 7/2005 Rogers
7,021,020 B2 4/2006 Simmons et al.
7,032,712 B2 4/2006 Schwörer
7,082,694 B2 8/2006 Lyman, Jr.
7,134,701 B1 11/2006 Ronning
7,469,485 B1 12/2008 Perdue
7,470,081 B2 12/2008 Miyahara et al.
D611,166 S 3/2010 Hammer
7,677,522 B2 3/2010 Bakos
7,941,985 B2 5/2011 Simmons
8,011,150 B2 9/2011 Luttrell et al.
8,056,299 B2 11/2011 Liskey
8,132,774 B1 3/2012 Whatcott
8,136,460 B2 3/2012 Tait et al.
8,161,698 B2 4/2012 Tait et al.
8,161,707 B2 4/2012 Simmons
8,297,002 B2 10/2012 Fernández Fernández
8,297,887 B2 10/2012 Ness et al.
8,522,507 B2 9/2013 Asada et al.
8,528,298 B2 9/2013 Semaan et al.
8,627,615 B2 1/2014 Moyher
8,646,232 B2 2/2014 Liskey
8,764,083 B2 * 7/2014 Belder ..... B66C 1/108 294/81.61
9,493,326 B2 11/2016 Simmons et al.
2002/0043038 A1 4/2002 Cerrato
2003/0178253 A1 9/2003 Tatge et al.
2004/0237439 A1 12/2004 Powell
2005/0066612 A1 3/2005 Simmons
2007/0256391 A1 11/2007 Mifsud et al.
2008/0245023 A1 10/2008 Simmons
2008/0282643 A1 11/2008 Devens
2008/0295443 A1 12/2008 Simmons
2009/0052980 A1 2/2009 Williams
2010/0316441 A1 12/2010 Vicentelli
2011/0031371 A1 2/2011 Rube
2012/0110947 A1 5/2012 Simmons
2012/0160137 A1 6/2012 Linares
2012/0292131 A1 11/2012 Lovas
2013/0319796 A1 12/2013 Davis
2014/0183330 A1 7/2014 Simmons et al.
2014/0202795 A1 7/2014 Simmons et al.
2014/0208666 A1 7/2014 Simmons et al.
2015/0091315 A1 4/2015 Butterfield, IV
2019/0249451 A1 8/2019 Boyd et al.
2019/0249452 A1 8/2019 King, Jr.

FOREIGN PATENT DOCUMENTS

FR 2054723 A 7/1971
FR 2471461 A1 6/1981
FR 2613403 A1 10/1988
GB 1204327 A 9/1970
GB 2261651 A 5/1993
JP 11-22001 A 1/1999
JP 2000-110236 A 4/2000
WO 98036134 A1 8/1998
WO 2011047830 A1 4/2011
WO 2015106291 A1 7/2015

OTHER PUBLICATIONS

U.S. Receiving Office of WIPO, Written Opinion of the International Searching Authority regarding PCT Patent Application No. PCT/US19/17373, dated Apr. 30, 2019, 5 pages.

Conxtech. 'ConX Modular Pipe Rack' [online]. Jan. 6, 2013. Retrieved from the internet: <http://www.conxtech.com/conx-system/conx-modular-pipe-rack/>; p. 1, figure 1, paragraphs 1, 2; p. 2, paragraph 1, 3 pages.

Conxtech Brochure. 'ConX Modular Pipe Rack' [online]. Apr. 16, 2014. Retrieved from the internet: <http://www.conxtech.com_wp-

(56) References Cited

OTHER PUBLICATIONS content_uploads_files_documents_ConX_Modular_Pipe_Rack_Brochure.pdf>; 25 pages.
The U.S. Receiving Office of WIPO, International Search Report and Written Opinion of the International Searching Authority regarding PCT Application No. PCT/US2014/013014, dated May 19, 2014, 6 pages.
U.S. Patent and Trademark Office, Office action regarding U.S. Appl. No. 14/163,778, dated Oct. 1, 2014, 16 pages.
U.S. Patent and Trademark Office, Office action regarding U.S. Appl. No. 14/163,778, dated Jan. 26, 2015, 16 pages.
The U.S. Receiving Office of WIPO, International Search Report and Written Opinion of the International Searching Authority regarding PCT Application No. PCT/2015/011270, dated Apr. 6, 2015, 6 pages.
The International Bureau of WIPO, International Preliminary Report on Patentability regarding PCT Application No. PCT/US2015/011270, dated Jul. 19, 2016, 5 pages.
The European Patent Office, Extended European Search Report regarding European Patent Application No. 15735326.9, dated Jun. 21, 2017, 8 pages.
U.S. Patent and Trademark Office, Non-Final Office Action regarding U.S. Appl. No. 16/271,746, dated Jun. 26, 2020, 11 pages.

* cited by examiner

MOMENT CONNECTION COMPONENT LIFTING TOOL ASSEMBLY

CROSS-REFERENCES

This application claims the benefit under 35 U.S.C. § 119(e) of the priority of U.S. Provisional Patent Application Ser. No. 62/628,837, filed Feb. 9, 2018, and of U.S. Provisional Patent Application Ser. No. 62/628,807, filed Feb. 9, 2018, the entireties of which are hereby incorporated by reference for all purposes. U.S. Pat. No. 7,941,985 B2 is also incorporated by reference herein, in its entirety, for all purposes.

INTRODUCTION

Steel frame building construction requires connection of beams and columns, and moment resisting connections are needed for continuous frames. Collar beam mounts offer a valuable improvement over on-site welding techniques. Welding can be done off site in controlled conditions, and frame members are seated in the proper spatial orientation when connected by a collar beam mount.

U.S. Pat. No. 7,941,985 B2 discloses an exemplary full moment collar beam mount, described as a halo/spider connection. Where a beam and a column connect, a collar flange assembly is welded to the end of the beam. Two collar corners are welded to corners on either side of a face of the column. To connect, the beam is lowered so that the flange assembly is received between the collar corners, which form a tapered channel. Connections on all faces of the column together form a full moment collar.

The beam connections allow precise building frame construction, but also require precise manufacturing. Along the length of a building frame, many beam and column connections line up and tolerances from multiple components may additively, adversely affect another connection. This can result in undesirable overall deviation from specifications. Manufacturing tools and methods are needed to facilitate precise positioning and welding of beam connection components in the manufacturing process.

A critical factor in precise alignment between components is lifting and transporting intermediate structures in the manufacturing process. A collar flange assembly is prohibitively heavy for manual manipulation, but does not include an attachment point for an overhead crane. Yet, both the upper and lower flanges, and full collar flange assembly need to be lifted, lowered, and adjusted into correct alignment in a safe and efficient manner.

SUMMARY

The present disclosure provides systems, apparatuses, and methods relating to full moment collar component lifting tool assemblies. In some examples, a lifting tool assembly may include a crossbar having a long axis spanning between first and second end portions. A first hook member may be pivotably suspended from the first end portion and a second hook member may be pivotably suspended from the second end portion. The end portions may be symmetrically angled relative to the long axis and each hook member may include first and second finger structures.

In some examples, a lifting tool assembly may include a crossbar having a long axis spanning between first and second end portions. A first hook member may be pivotably suspended from the first end portion and a second hook member may be pivotably suspended from the second end portion. The end portions may be angled inward, and the hook members may be configured to support first and second wing portions of a flange member of a full moment collar flange assembly.

In some examples, a method of lifting a full moment collar flange assembly may include connecting a lifting tool assembly to a lifting apparatus and positioning a crossbar of the lifting tool assembly over a main body portion of a flange member of a full moment collar flange assembly. The method may further include pivoting a first hook member down to abut a first wing portion of the flange member, and pivoting a second hook member down to abut a second wing portion of the flange member.

Features, functions, and advantages may be achieved independently in various examples of the present disclosure, or may be combined in yet other examples, further details of which can be seen with reference to the following description and drawings.

DETAILED DESCRIPTION

Figure 1:
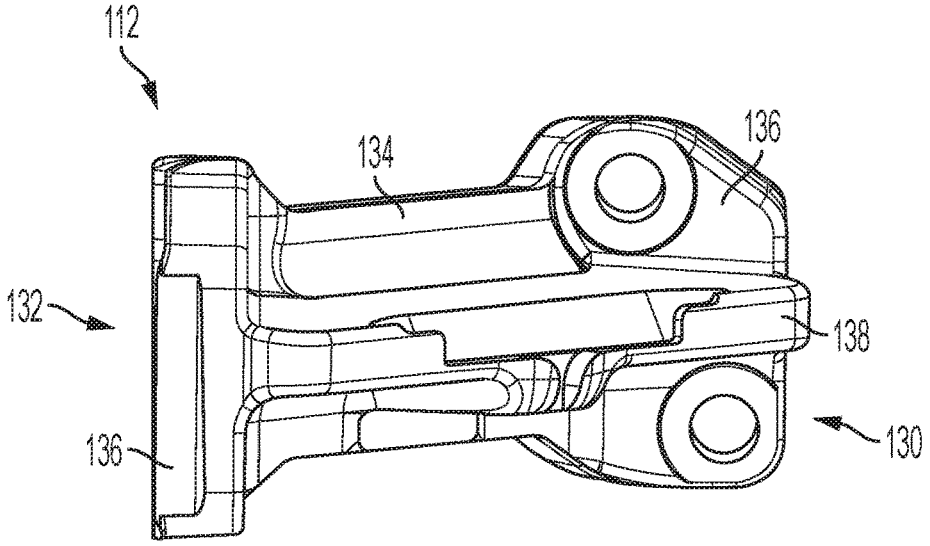
FIG. 1 is an isometric view of an illustrative flange member.

Various aspects and examples of a component lifting tool assembly having angled hook arms as well as related methods of use, are described below and illustrated in the associated drawings. Unless otherwise specified, a component lifting tool assembly in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2) Examples, Components, and Alternatives; (3) Illustrative Combinations and Additional Examples; (4) Advantages, Features, and Benefits; and (5) Conclusion. The Examples, Components, and Alternatives section is further divided into subsections A and B, each of which is labeled accordingly.

Overview

In general, a component tool assembly may also be referred to as a flange hook, and may include a main body, a connection point, and two hook arms. The flange hook may have dimensions and geometry appropriate to conform to angled corners or wings of a flange of a collar flange assembly of a full moment collar beam mount. The hook may be configured to support the flange and couple to an appropriate lifting mechanism.

The main body may include a crossbar defining a long axis, and may have a geometry corresponding to a front face and angled wings of the flange. In other words, the main body may have a central extent spanning between a first end and second end portion. The two end portions may be angled inward, the two angles being approximately equal but mirrored.

A hook arm may be pivotably suspended from each of the angled end portions. For example, each hook arm may be mounted on an axle. The axles may be disposed such that the hook arms are pivotable about an axis that forms an acute angle with the long axis defined by the crossbar of the main body. The hook arms may each have an elongate body, with a hook at a distal end.

In some examples, the hook may have a split hook configuration with two finger structures extending at two different angles relative to the elongate body. The split hook may include a floor portion generally perpendicular to the elongate body, a first finger structure extending toward the main body of the flange hook and generally parallel to the elongate body of the hook arm, and a second finger structure extending inward and toward the main body of the flange hook.

In some examples, the connection point may comprise an aperture in the crossbar of the main body. The connection point may also be coupled to the main body such that when the hook is coupled to the flange and to a lifting mechanism, with the flange being supported solely by the hook, the flange may have a center of gravity located approximately below the connection point. That is, when the hook is in use transporting the flange, the flange may hang in a stable manner without asymmetrical tension or motion induced by gravitational forces. The same may be true when the hook is coupled to a collar flange assembly.

The connection point may be pivotably coupled to the main body. For instance, the connection point may include a projection having an aperture and mounted on an axle. The axle may be disposed such that the projection is pivotable around an axis parallel to the long axis defined by the crossbar of the main body. Such coupling may facilitate maintaining stability of a supported flange during motion. Pivotability may also facilitate support of flanges or corner flange assemblies with differently disposed centers of gravity. The connection point may be coupled to the main body such that a lifting mechanism coupled to the hook will be disposed vertically above a point laterally spaced from the main body.

When the hook engages a flange, the main body may be disposed above the flange and the hook arms may extend down along a front face of the angled corners of the flange. The hooks of the hook arms may be disposed below the angled corners of the flange, and may thereby support the flange. Further, the hooks may extend both out and up from the hook arms such that the hooks extend some distance along a rear face of the angled corners. The angled corners of the flange may be thereby secured between the hook arms and the hooks.

Examples, Components, and Alternatives

The following sections describe selected aspects of exemplary component lifting tool assemblies as well as related systems and/or methods. The examples in these sections are intended for illustration and should not be interpreted as limiting the entire scope of the present disclosure. Each section may include one or more distinct examples, and/or contextual or related information, function, and/or structure.

A. Illustrative Hook

As shown in FIGS. 2-5, this section describes an illustrative flange hook 10. Hook 10 is an example of a component lifting tool assembly, described above. FIG. 1 is an isometric view of an illustrative upper flange member 112 of a collar flange assembly. A full flange assembly may further include a lower flange member and a bridging component. Upper flange member 112 and each component of the assembly have a beam facing side 130 and a column facing side 132. The flange member includes a main body with a central span 134 and angled wing portions 136 extending from each end. A crosspiece 138 extends from beam facing side 130 of the main body and wing portions. Hook 10 is configured to support a collar flange assembly by engaging upper flange member 112.

Figure 2:
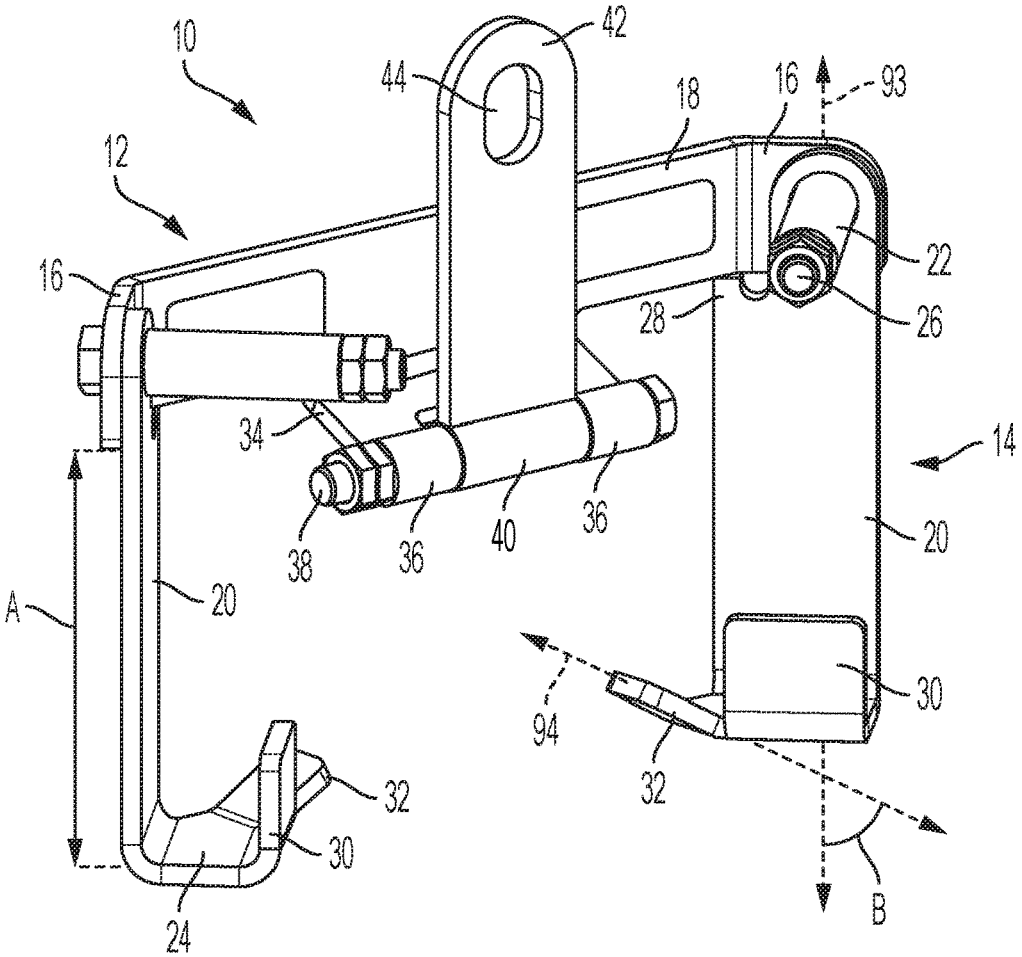
FIG. 2 is an isometric view of an illustrative flange hook in accordance with aspects of the present disclosure.
Figure 3:
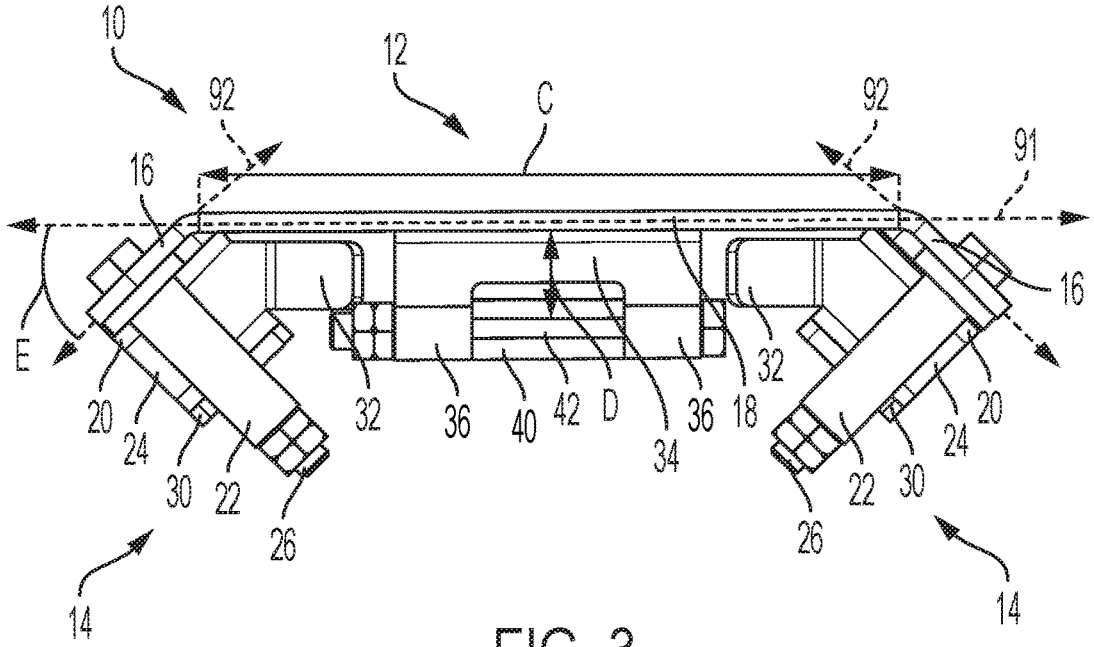
FIG. 3 is a top view of the flange hook of FIG. 2.

As shown in FIG. 2, hook 10 includes a main support 12, with two arms 14. The main support includes a wing 16 at each end of a central span 18, extending at an angle relative to the central span. As shown in FIG. 3, central span 18 defines a lateral axis 91, and each wing defines a wing axis 92. The two wing axes 92 may be approximately orthogonal to one another. Each wing axis 92 may form approximately the same angle with lateral axis 91. In some example each wing axis 92 may form an angle of approximately 45 degrees, approximately 60 degrees, or any appropriate angle with lateral axis 91.

Referring again to FIG. 2, an arm 14 is coupled to each of wings 16. Each arm includes a vertical member 20 with a sleeve 22 mounted on an aperture at a top end of the vertical member, and a horizontal portion 24 at a bottom end of the vertical member. Sleeve 22 is sized to receive an arm axle 26. Arm 14 is disposed relative to main support 12 such that sleeve 22 and the aperture at the top of vertical member 20 are aligned with an aperture in corresponding wing 16. Arm axle extends through sleeve 22 and the aperture in the wing. Arm 14 is thereby rotatably coupled to main support 12. In the present example an axle is used, but any effective rotatable or pivotable coupling may also be used.

A rotation stop 28 is formed on vertical member 20 of arm 14. The stop is disposed on an inner edge of the vertical member, such that it may be brought into contact with an underside of central span 18 when arm 14 is rotated in a first, inward direction. Such contact with the central span may prevent rotation of arm 14 in the first direction, past a desired angle. Arm 14 may be free to rotate in a second, outward direction. In the pictured example, rotation stop 28 may prevent arm 14 from rotating past a vertical alignment in the first direction.

To put it another way, main support 12 may define three vertical planes, one defined by central span 18 and containing lateral axis 91, and two defined by wings 16 and containing wing axes 92. Each arm 14 may be rotatable from a vertical alignment in which an arm axis 93 defined by vertical member 20 is perpendicular to the axis 92 of the corresponding wing. The arms may be rotatable in one direction such that arm axis 93 remains parallel to the plane defined by the corresponding wing.

At the bottom end of vertical member 20, horizontal portion 24 extends at approximately a right angle to the vertical member. A primary tab 30 extends up from the horizontal portion, parallel to vertical member 20 and on an edge of the horizontal portion generally opposite the vertical member. Primary tab 30 may also be described as extending in a plane parallel to, but spaced from the plane defined by the corresponding wing.

A secondary tab 32 extends from horizontal portion 24 at an angle. A plane defined by secondary tab 32 may not be parallel to any of the three planes defined by main support 12. The defined plane also may not include arm axis 93. An intersection between the plane defined by the secondary tab 32 and the plane defined by central span 18 may be a line 94 that forms an angle E with arm axis 93. The angle may be approximately 20 degrees, may be 90 degrees, or may be any appropriate angle. As can be most clearly seen in FIG. 3, secondary tab 32 may also be described as extending parallel to central span 18, but at an angle relative to arm axis 93.

Main support 12 further includes a central projection 34, extending down and in from central span 18 at an angle. The central projection has two cylindrical members 36 sized to receive a central axle 38. Disposed between cylindrical members 36 is a cylindrical portion 40 of a connection plate 42. Together cylindrical members 36 and cylindrical portion 40 form a sleeve or axle tube for central axle 38. Connection plate 42 is thereby pivotably mounted to central projection 34 and main support 12.

In the pictured example, connection plate 42 includes an elongate aperture 44. The aperture may function as a connection point for a lifting device such as an overhead crane. For example, a shackle may be bolted to the aperture and the hook of a crane connected to the shackle. For another example, ropes or cables may be threaded through apertures. Any appropriate connector may be used in place of or in combination with aperture 44.

Central projection 34 may be located such that axle 38 and connection plate 42 are disposed over a center of gravity of a supported flange member or collar flange assembly. Along with the pivotable connection of plate 42, this may allow a supported component to hang stably and vertically. Additionally, a flange member or collar flange assembly may be secured by hook 10 when in a horizontal or other non-vertical alignment. When lifted by the hook, the component may be automatically returned to a balanced vertical alignment.

Dimensions and angles of hook 10 may be configured to correspond to an upper flange of a collar flange assembly. Arm 14 may have a length A, shown in FIG. 2 and measured from a bottom edge of main support 12 to a top of horizontal portion 24, which corresponds to a height of a wing of the flange. Angle B between line 94 defined by secondary tab 32 and arm axis 93 may correspond to a slope of a bottom edge of the central span of the flange.

Central span 18 may have a width C, shown in FIG. 3, corresponding to a width of a central span of the flange. Dimension D is measured from central span 18 to central axle 38 and may correspond to a horizontal distance from a front face of the flange to a center of mass of the collar flange assembly. Angle E between wing axis 92 and lateral axis 91 may correspond to an angle between the wing and the central span of the flange.

Figure 4:
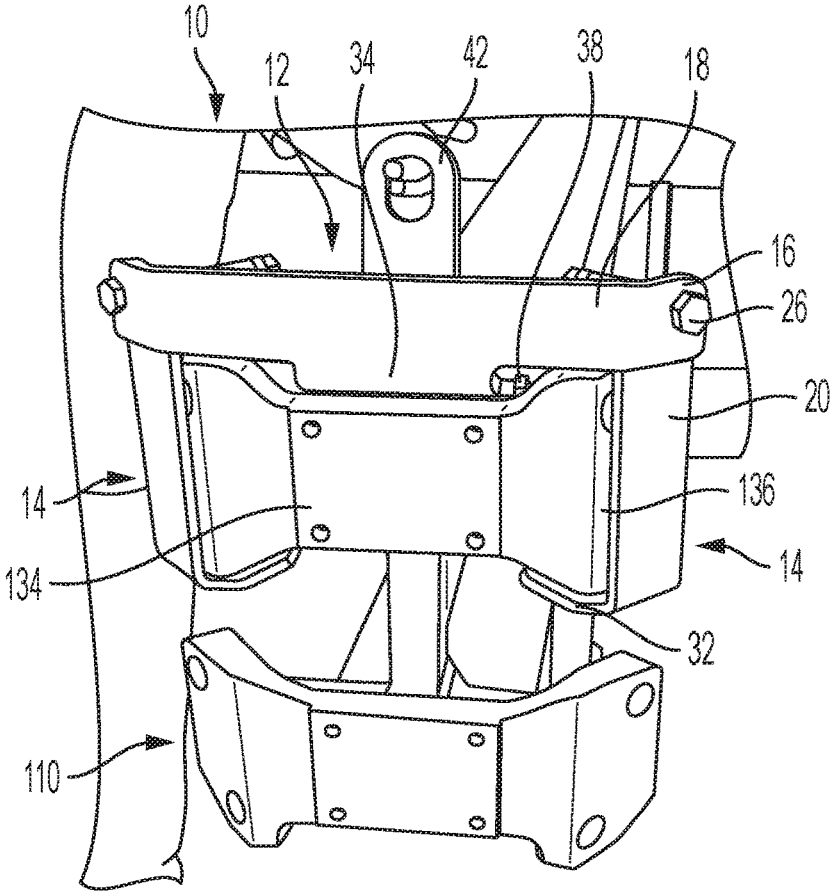
FIG. 4 is a front plan view of the flange hook of FIG. 2, supporting a collar flange assembly.
Figure 5:
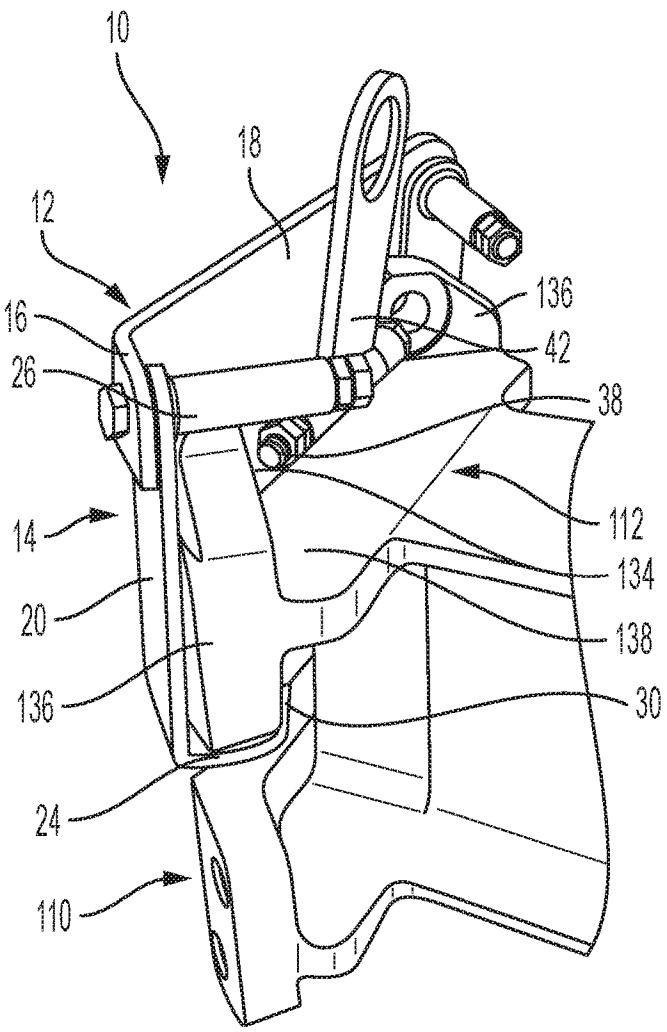
FIG. 5 is an isometric side view of the flange hook of FIG. 2, supporting a collar flange assembly.

FIGS. 4 and 5 show hook 10 supporting a collar flange assembly 110. As shown, assembly 110 has been welded to a beam, but hook 10 may engage assembly equivalently when not attached to a beam. Main support 12 is disposed above upper flange 112 of collar flange assembly 110. Vertical member 20 of each arm 14 abuts a front surface of a wing 136 of upper flange 112. Horizontal portion 24 extends back from vertical member 20 and under wing 136. At a rear of wing 136, primary tab 30 extends up along a beam-facing surface of the wing. Wing 136 is thereby supported and secured by arm 14.

As shown in FIG. 4, secondary tab 32 of each arm 14 extends out from horizontal portion 24 and along an underside of a central span 134 of upper flange 112. Upper flange 112 may be thereby further supported and secured by secondary tab 32. In the pictured example, central span 134 narrows from wing 136 toward a rectangular section. Secondary tab 32 may conform to this slope, and extend at an upward angle relative to horizontal portion 24. Arm 112 may be thereby prevented from rotating outward while upper flange 112 is supported. In some examples secondary tab 32 may extend horizontally, may be curved to conform to a curve of central span 134, or may have any effective shape. In some examples, arm 14 may include only primary tab 30 and not secondary tab 32.

As shown in FIG. 5, central projection 34 extends sufficiently for central axle 38 to be disposed behind central span 134, above a crosspiece 138 of upper flange 112. When lifting force is applied through connection plate 42, the force may therefore be centered over collar flange assembly 110.

B. Illustrative Method

Figure 6:
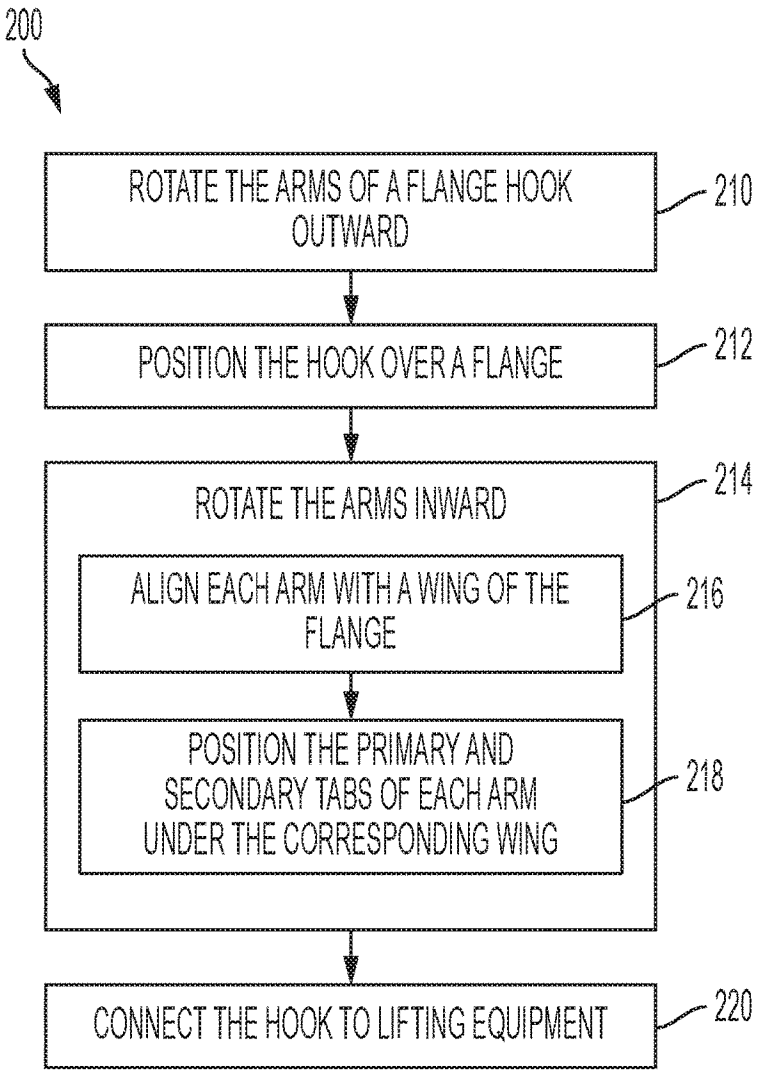
FIG. 6 is a flow chart depicting steps of an illustrative method for lifting a flange member, according to the present teachings.

This section describes steps of an illustrative method for lifting a flange or collar flange assembly; see FIG. 6. Aspects of flange hooks or component lifting assemblies described above may be utilized in the method steps described below. Where appropriate, reference may be made to components and systems that may be used in carrying out each step. These references are for illustration, and are not intended to limit the possible ways of carrying out any particular step of the method.

FIG. 6 is a flowchart illustrating steps performed in an illustrative method, and may not recite the complete process or all steps of the method. Although various steps of method 200 are described below and depicted in FIG. 6, the steps need not necessarily all be performed, and in some cases may be performed simultaneously or in a different order than the order shown.

Prior to loading onto a hook, a collar flange assembly may be supported by a shelf or other storage structure such that clearance exists in front of the central span of the upper flange. The hook may be positioned in front of the central span of the upper flange, with a main support of the hook parallel to the central span. Positioning may be done manually, or by a lifting device secured to a connection plate of the hook.

At step 210, the method includes rotating the arms of a flange hook outward. Both of two arms of the hook may be rotated outward and upward from a vertical position, clear of the upper flange and allowing the main support to be advanced toward the collar flange assembly until disposed above the upper flange. Step 212 includes positioning the hook over the flange. The main support of the hook may be positioned above and immediately in front of the central span of the upper flange, while an axle on which the connection plate is mounted may be disposed behind the central span.

Step 214 includes rotating the arms inward. Each arm may be rotated back down to the vertical position, such that the arm abuts a front surface of a wing of the upper flange. Substep 216 of step 214 includes aligning each arm with a wing of the flange. Substep 218 includes positioning a primary and a secondary tab of the arm of each arm under the corresponding wing. The tabs may slide under the wing as the arm is rotated. With the arm in the vertical position, the primary tab may extend under the wing and back up behind the wing. The secondary tab may extend under the central span of the flange. The flange may be thereby secured on the hook.

Step 220 includes connecting the hook to lifting equipment. A lifting device may be coupled to the connection plate of the hook. When lifted, the hook may in turn lift the collar flange assembly, with the upper flange supported on the primary and secondary tabs of the arms. Step 220 may also be performed prior to step 210, to aid in positioning of the hook.

Illustrative Combinations and Additional Examples

This section describes additional aspects and features of component gripping apparatus, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A. A lifting tool assembly, comprising:

a main body including a central base portion spanning first and second opposing end portions, each of the opposing end portions supporting an axle, each axle having a rotational axis forming an acute angle with an extended long axis of the central base portion.

A1. The lifting tool assembly of A, wherein the central base portion has an aperture for connecting the tool to a lifting apparatus.

A2. The lifting tool assembly of A or A1, further comprising: first and second hook members pivotally connected to the axles supported by the first and second end portions, respectively.

B. A tool assembly, comprising:

A crossbar having a long axis spanning between first and second end portions,

A first hook member suspended from the first end portion, and a second hook member suspended from the second end portion, the end portions being angled inward for each of the hook members to engage a side portion of a collar flange assembly.

B1. The tool assembly of B, wherein the crossbar has an aperture for connecting the tool to a lifting apparatus.

B2. The tool assembly of B or B1, wherein the crossbar has a projection extending from a central region, the projection having an aperture for connecting the tool to a lifting apparatus.

B3. The tool assembly of B2, wherein the projection is pivotably mounted on an axle, the projection being pivotable around an axis parallel to the long axis of the crossbar.

B4. The tool assembly of any of B-B3, wherein each hook member is mounted on an axle, each hook member being pivotable around an axis forming an acute angle with the long axis of the crossbar.

B5. The tool assembly of any of B-B4, wherein each hook member has a main body portion and a split hook configuration at a distal end.

B6. The tool assembly of B5, wherein each split hook configuration includes a floor portion, a first finger structure extending upward from the floor portion substantially parallel with the main body portion, and a second finger structure inclined inward relative to the main body portion.

C. A lifting tool assembly, comprising:

A crossbar having a long axis spanning between first and second end portions, a first hook member pivotably suspended from the first end portion; and a second hook member pivotably suspended from the second end portion;

wherein the end portions are symmetrically angled relative to the long axis and each hook member includes first finger structure and a second finger structure.

C1. The lifting tool assembly of C, wherein the crossbar has an aperture for connecting the tool to a lifting apparatus.

C2. The lifting tool assembly of C, wherein the crossbar has a projection extending from a central region, the projection having an aperture for connecting the tool to a lifting apparatus.

C3. The lifting tool assembly of C2, wherein the projection is pivotably mounted on an axle, the projection being pivotable around an axis parallel to the long axis of the crossbar.

C4. The lifting tool assembly of any of C-C3, wherein each hook member is mounted on an axle, each hook member being pivotable around an axis forming an acute angle with the long axis of the crossbar.

C5. The lifting tool assembly of any of C-C4, wherein each hook member has a main body portion and a split hook at a distal end.

C6. The lifting tool assembly of C5, wherein each split hook includes a floor portion, the first finger structure extending upward from the floor portion substantially parallel with the main body portion, and the second finger structure inclined inward relative to the main body portion.

C7. The lifting tool assembly of any of C-C7, wherein each of the crossbar, first hook member, and second hook member are comprised of formed sheet metal.

D. A lifting tool assembly, comprising:

A crossbar having a long axis spanning between first and second end portions;

A first hook member pivotably suspended from the first end portion; and a second hook member pivotably suspended from the second end portion;

wherein the end portions are angled inward, and the hook members are configured to support first and second wing portions of a flange member of a full moment collar flange assembly.

D1. The lifting tool assembly of D, wherein each hook member has a main body portion and a split hook at a distal end of the main body portion.

D2. The lifting tool assembly of D1, wherein each split hook includes a floor portion, a first finger structure extending upward from the floor portion substantially parallel with the main body portion, and a second finger structure inclined inward relative to the main body portion.

D3. The lifting tool assembly of D2, wherein the floor portion contacts an underside of a wing portion of a supported flange member, the first finger structure extends along a beam-facing side of the wing portion, and the second finger structure extends along an underside of a main body portion of the flange member.

D4. The lifting tool assembly of D2 or D3, wherein the crossbar has a projection extending from a central region, the projection having an aperture for connecting the tool to a lifting apparatus.

D5. The lifting tool assembly of D4, wherein the projection is pivotably mounted on an axle, the projection being pivotable around an axis parallel to the long axis of the crossbar.

D6. The lifting tool assembly of D5, wherein the axle is disposed on a beam-ward side of a main body portion of a supported flange assembly.

D7. The lifting tool assembly of any of D-D6, wherein each hook member is mounted on an axle, each hook member being pivotable around an axis forming an acute angle with the long axis of the crossbar.

D8. The lifting tool assembly of D7, wherein each axle is disposed above a wing portion of a supported flange member.

E. A method of lifting a full moment collar flange assembly, comprising:

connecting a lifting tool assembly to a lifting apparatus;

positioning a crossbar of the lifting tool assembly over a main body portion of a flange member of a full moment collar flange assembly;

pivoting a first hook member down to abut a first wing portion of the flange member;

pivoting a second hook member down to abut a second wing portion of the flange member.

E1. The method of E, wherein pivoting each hook members includes positioning a floor portion of a split hook under the wing portion, a first finger structure of the split hook along a beam-facing side of the wing portion, and a second finger structure under the main body portion of the flange member.

E2. The method of E or E1, wherein pivoting each hook member includes pivoting the hook member about an axle mounted to an angled end portion of the crossbar of the lifting tool assembly.

Advantages, Features, and Benefits

The different examples of the component lifting tool assembly described herein provide several advantages over known solutions for transporting full moment collar flange assemblies. For example, illustrative examples described herein allow access to beam-facing surfaces of a supported collar flange assembly.

Additionally, and among other benefits, illustrative examples described herein allow secure transport without the need for other tools or fasteners.

Additionally, and among other benefits, illustrative examples described herein are lightweight and can be manufactured from inexpensive materials.

Additionally, and among other benefits, illustrative examples described herein allow balanced and stable lifting of collar flange assemblies.

Additionally, and among other benefits, illustrative examples described herein improve safety for workers handling heavy components.

No known system or device can perform these functions, particularly for the specific geometry of a collar flange assembly. Thus, the illustrative examples described herein are particularly useful for manufacture of full moment collar connections. However, not all examples described herein provide the same advantages or the same degree of advantage.

Conclusion

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A lifting tool assembly, comprising:

a crossbar having a long axis spanning between first and second end portions, a first hook member pivotably suspended from the first end portion; and a second hook member pivotably suspended from the second end portion;

wherein the end portions are symmetrically angled relative to the long axis and each hook member includes a main body portion, a first finger structure extending upward substantially parallel with the main body portion, and a second finger structure inclined inward relative to the main body portion.

2. The lifting tool assembly of claim 1, wherein the crossbar has an aperture for connecting the lifting tool assembly to a lifting apparatus.

3. The lifting tool assembly of claim 1, wherein the crossbar has a projection extending from a central region, the projection having an aperture for connecting the lifting tool assembly to a lifting apparatus.

4. The lifting tool assembly of claim 3, wherein the projection is pivotably mounted on an axle, the projection being pivotable around an axis parallel to the long axis of the crossbar.

5. The lifting tool assembly of claim 1, wherein each hook member is mounted on an axle, each hook member being pivotable around an axis forming an acute angle with the long axis of the crossbar.

6. The lifting tool assembly of claim 1, wherein the first and second finger structures of each hook member comprise a split hook at a distal end of the main body portion.

7. The lifting tool assembly of claim 6, wherein each split hook includes a floor portion, the first finger structure extending from the floor portion.

8. The lifting tool assembly of claim 1, wherein each of the crossbar, first hook member, and second hook member are comprised of formed sheet metal.

9. A lifting tool assembly, comprising:

a crossbar having a long axis spanning between first and second end portions;

a first hook member pivotably suspended from the first end portion; and a second hook member pivotably suspended from the second end portion;

wherein the end portions are angled inward at an angle corresponding to first and second angled wing portions of a flange member of a full moment collar flange assembly, and the hook members are configured to support the first and second angled wing portions;

wherein each hook member has a main body portion and a split hook at a distal end of the main body portion, the split hook including a floor portion, a first finger structure extending upward from the floor portion substantially parallel with the main body portion, and a second finger structure inclined inward relative to the main body portion.

10. The lifting tool assembly of claim 9, wherein the floor portion contacts an underside of a wing portion of a supported flange member, the first finger structure extends along a beam-facing side of the wing portion, and the second finger structure extends along an underside of a main body portion of the flange member.

11. The lifting tool assembly of claim 9, wherein the crossbar has a projection extending from a central region, the projection having an aperture for connecting the lifting tool assembly to a lifting apparatus.

12. The lifting tool assembly of claim 11, wherein the projection is pivotably mounted on an axle, the projection being pivotable around an axis parallel to the long axis of the crossbar.

13. The lifting tool assembly of claim 12, wherein the axle is disposed on a beam-ward side of a main body portion of a supported flange assembly.

14. The lifting tool assembly of claim 9, wherein each hook member is mounted on an axle, each hook member being pivotable around an axis forming an acute angle with the long axis of the crossbar.

15. The lifting tool assembly of claim 14, wherein each axle is disposed above a wing portion of a supported flange member.

16. A method of lifting a full moment collar flange assembly, comprising:

connecting a lifting tool assembly to a lifting apparatus;

positioning a crossbar of the lifting tool assembly over a main body portion of a flange member of a full moment collar flange assembly;

pivoting a first hook member down to abut a first wing portion of the flange member;

pivoting a second hook member down to abut a second wing portion of the flange member;

wherein pivoting each hook member includes positioning a floor portion of a split hook under the wing portion, a first finger structure of the split hook along a beam-facing side of the wing portion, and a second finger structure under the main body portion of the flange member.

17. The method of claim 16, wherein pivoting each hook member includes pivoting the hook member about an axle mounted to an angled end portion of the crossbar of the lifting tool assembly.

* * * * *